US006464098B1

(12) United States Patent
Henson et al.

(10) Patent No.: US 6,464,098 B1
(45) Date of Patent: Oct. 15, 2002

(54) COLLAPSIBLE UTILITY ORGANIZER

(76) Inventors: Jerry A. Henson, P.O. Box 774871, Steamboat Springs, CO (US) 80477; Russell L. Overgaard, P.O. Box 1142, Steamboat Springs, CO (US) 80477

( * ) Notice: Subject to any disclaimer, the term of this patent is extended or adjusted under 35 U.S.C. 154(b) by 7 days.

(21) Appl. No.: 09/698,365

(22) Filed: Oct. 27, 2000

Related U.S. Application Data

(60) Provisional application No. 60/162,453, filed on Oct. 29, 1999.

(51) Int. Cl.[7] ..... B65D 25/22
(52) U.S. Cl. ..... 220/475; 224/651
(58) Field of Search ..... 224/651, 653, 224/153; 383/38, 117; 190/109, 115; 220/475

(56) References Cited

U.S. PATENT DOCUMENTS 4,580,667 A * 4/1986 Herwood ..... 150/113
4,874,119 A * 10/1989 Winter ..... 190/110
5,819,999 A * 10/1998 Tennant ..... 224/153
6,161,739 A * 12/2000 Bentzen ..... 224/153

* cited by examiner

*Primary Examiner*—Stephen Castellano
(74) *Attorney, Agent, or Firm*—Sheridan Ross P.C.

(57) ABSTRACT

A portable, collapsible utility organizer is provided with a plurality of shelves in its interior for accommodating, in its expanded position, various goods, such as containers, food stuffs, equipment, etc. Exterior compartments are provided, as well as attachment means for dowel rods which can accommodate paper towels, toilet paper, hooks for hanging various utensils, etc. The organizing device, once emptied, is collapsible to a relatively flat and convenient dimension for easy transport.

2 Claims, 3 Drawing Sheets

COLLAPSIBLE UTILITY ORGANIZER

RELATED APPLICATION

This application claims priority from U.S. Provisional Patent Application No. 60/162,453 filed in Oct. 29, 1999. The entire disclosure of the provisional application is considered to be part of the disclosure of the accompanying application and is hereby incorporated by reference.

FIELD OF THE INVENTION

The present invention is directed to a portable, collapsible utility organizer, and in particular, an organizer made of tough, lightweight, water resistant material that collapses in an accordion-like fashion and that, when expanded, contains a plurality of shelves and compartments to accommodate storage of a variety of accessories and/or food stuffs.

BACKGROUND OF THE INVENTION

Various carryall bags and collapsible organizers are known for use in maintaining various types items in an organized state. Many of such carrying bag devices are designed for particular uses, for example, U.S. Pat. No. 4,468,810, issued to Longo, is directed to a convertible carrying bag and U.S. Pat. No. 4,156,446, issued to Nathan, is directed to a tote bag. Still others are a combination of chairs and pocket devices such as that disclosed in U.S. Pat. No. 4,553,785, issued to Duke which discloses a terrycloth cover with inwardly facing pockets to fit over the head and legs of a chair. Other collapsible structures are used for dividing the area of car trunks to hold grocery bags securely during transport (e.g. U.S. Pat. No. 3,986,656 to November.) Yet other devices are directed to collapsible containers formed of corrugated paperboard or other material, such as solid or foam plastic, with walls cooperating with legs and reversibly folding along scorelines (e.g. U.S. Pat. No. 5,036, 979 to Selz.)

There remains a need, however, for a lightweight portable, collapsible/foldable utility organizer suitable for a variety of uses beyond transport of items. In particular, a collapsible storage cabinet organizer that has both outside as well as inside storage compartments suitable for storing general items as well as food stuffs, and in addition that accommodates easy access to paper towel dispensers and further would solve a long felt but unsolved need, namely that of a lightweight, collapsible, portable pantry cupboard or accessory cabinet.

SUMMARY OF THE INVENTION

The present invention is directed to a portable, collapsible, utility cabinet organizer preferably made of tough, light weight, water resistant material, such as nylon. The organizer has a plurality of shelves in its interior, preferably being at least about 20 inches long and separated by a desired distance, for example, at least about ten inches apart. Although the organizer can be of any particular configuration including length, width and height, in a preferred embodiment the organizer extends to approximately 30 inches tall and collapses in an accordion-like fashion to pack down to less than about two inches tall. Preferably, the organizer is constructed so as to weigh less than about ten pounds, more preferably less than about seven pounds, and even more preferably around five pounds. In a preferred embodiment, the organizer is configured so that it easily fits into a gear box or pannier for space-saving transport.

In a preferred embodiment, three enclosable waterproof storage and/or food shelves are provided which can be covered with a cover attached to the device either by zippers, velcro, snaps, or other suitable attachment means. A plurality of outer pockets are provided for utensils or other necessities. In a preferred embodiment, six divided outer pockets are provided. Such pockets are useful, for example, for storing flashlights, first aid kits, containers, etc.

The organizer itself can be configured to hang from a tent, trailer, RV, tree, or other suitable support. The mesh pockets allow for visual identification of the contents, as well as being useful for air-drying of wet utensils. The solid pocket allows for weather resistant, secure, enclosed storage. Indeed, the organizer cabinet of the present invention can be used in a tack room, shop or barn to store appropriate materials for a variety of uses, including a portable chuck box, equine cabinet, showbag, event chest, etc.

The present organizer provides a unique and convenient way for campers, hunters, horseback enthusiasts, etc. to store particular items, including food items, tools, medicines, etc. in a convenient manner such that such items can be easily accessed upon reaching a particular destination. For example, gear, food and equipment can be transported in the most bulk-efficient, safe, space-saving manner, then transferred to the organizer for secure, convenient access. In a preferred embodiment, the organizer is enclosable such that items stored inside the organizer are maintained in a dry and secure environment.

In one particular embodiment to the present invention, a storage organizer device of the present invention has at least one descending attachment means for connecting a dowel rod, such dowel rod suitable for hanging various materials such as hooks, tools, gloves, towels, and particularly, accommodating a toilet paper or paper towel cylinder. In one embodiment, the device has one or more loops positioned on the bottom sides of the organizing device, such loops suitable for accepting a dowel rod therethrough.

In a particular embodiment, the top of the device is designed as a "pocket" to accept a rigid shelf, thus providing a structure to add stability to the device when in use. Adjustable hanging straps are located on the top-most portion of the device, preferably along the edge of the device, and are preferably constructed so as to continue under the top pocket to provide additional support to the entire device when in a hanging position. A combination of the rigid shelf at the top of the device, in conjunction with the hanging straps, allows the device to support much more weight and bulk than if it were hung from lighter weight outer fabric.

Although the device of the present invention is generally referred to as an organizer, it can alternatively be referred to as a cabinet, pantry or cupboard having the characteristics of being portable, collapsible and lightweight.

DETAILED DESCRIPTION OF THE PREFERRED EMBODIMENT

Figure 1:
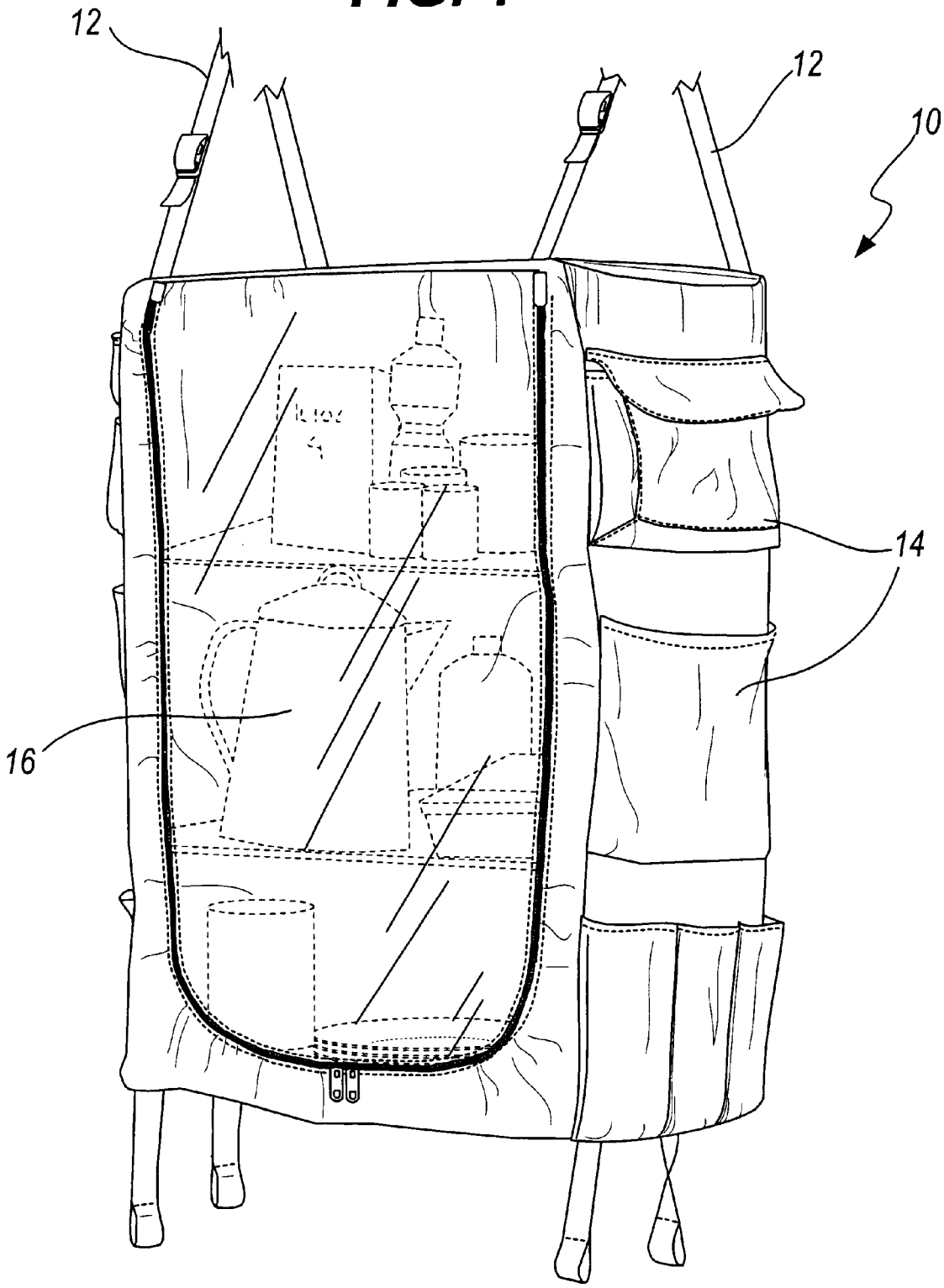
FIG. 1 illustrates the organizing device of the present invention with a closed outer housing compartment, connecting straps from which the organizer descends and compartments facilitated on the side width portions thereof.

As illustrated in FIG. 1, in a fully extended and closed orientation, the device 10 of the present invention has means for hanging the device vertically 12, such as to adjustable straps located on each top edge of the organizing device 10. The width sides of the device have a plurality of pocket enclosures 14, some of which are closeable to seal the contents therein from the outside, with others being open at the top of such pockets to accommodate insertion and securement of various materials. Some of such pockets are further divided to accommodate, for example, bottles, cans, etc. of various materials. The front face 16 of the device 10 is preferably closeable by a length of fabric, closeable to the device itself through a zipper means, velcro, buttons, snaps, etc. In one embodiment (not shown), instead of fabric covering the front face 16 of the organizing device 10, one or more transparent windows are provided so that one can view at least portions of the interior of the organizing device 10.

Figure 2:
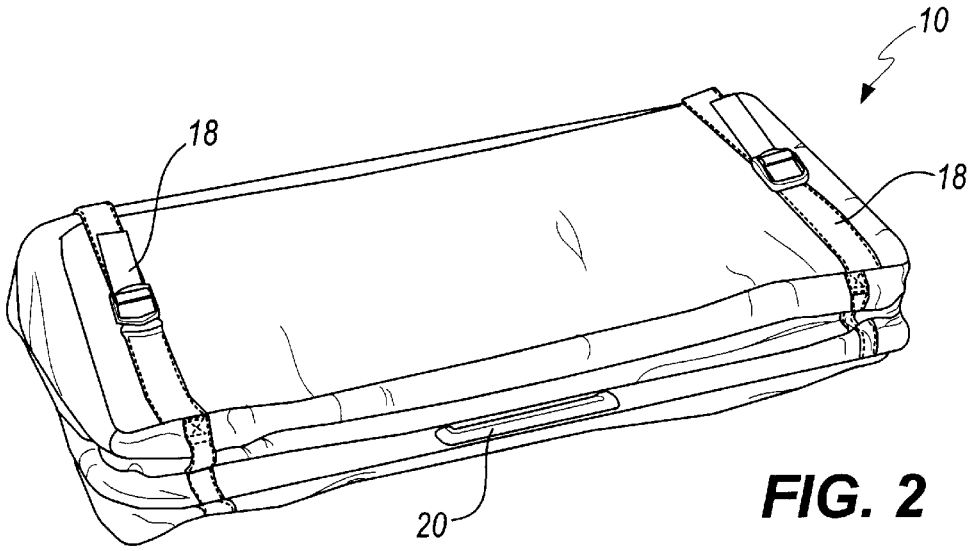
FIG. 2 shows the organizer of the present invention in a collapsible and securable state.

As can be seen by reference to FIG. 2, the device is collapsible to a relatively flat configuration and can be secured in such a configuration by various means, including straps 18 that encompass the exterior portion of the collapse device, snaps, velcro, and other closure means known in the art 18. A carrying handle 20 for the device can be provided on one of the flattened sides of such device to facilitate carrying.

Figure 4:
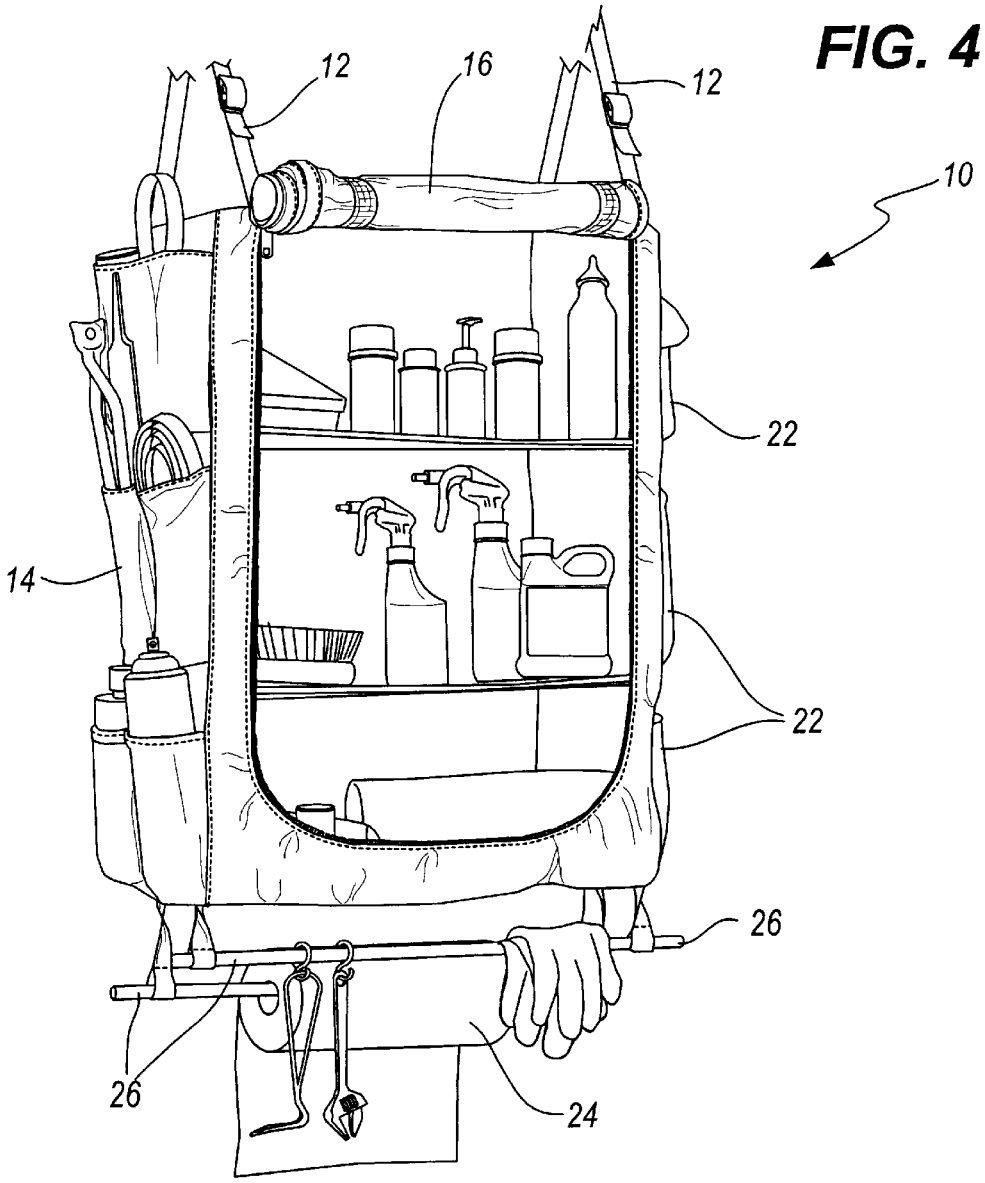
FIG. 4 illustrates how different articles can be stored in and on the organizer of the present invention.
Figure 3:
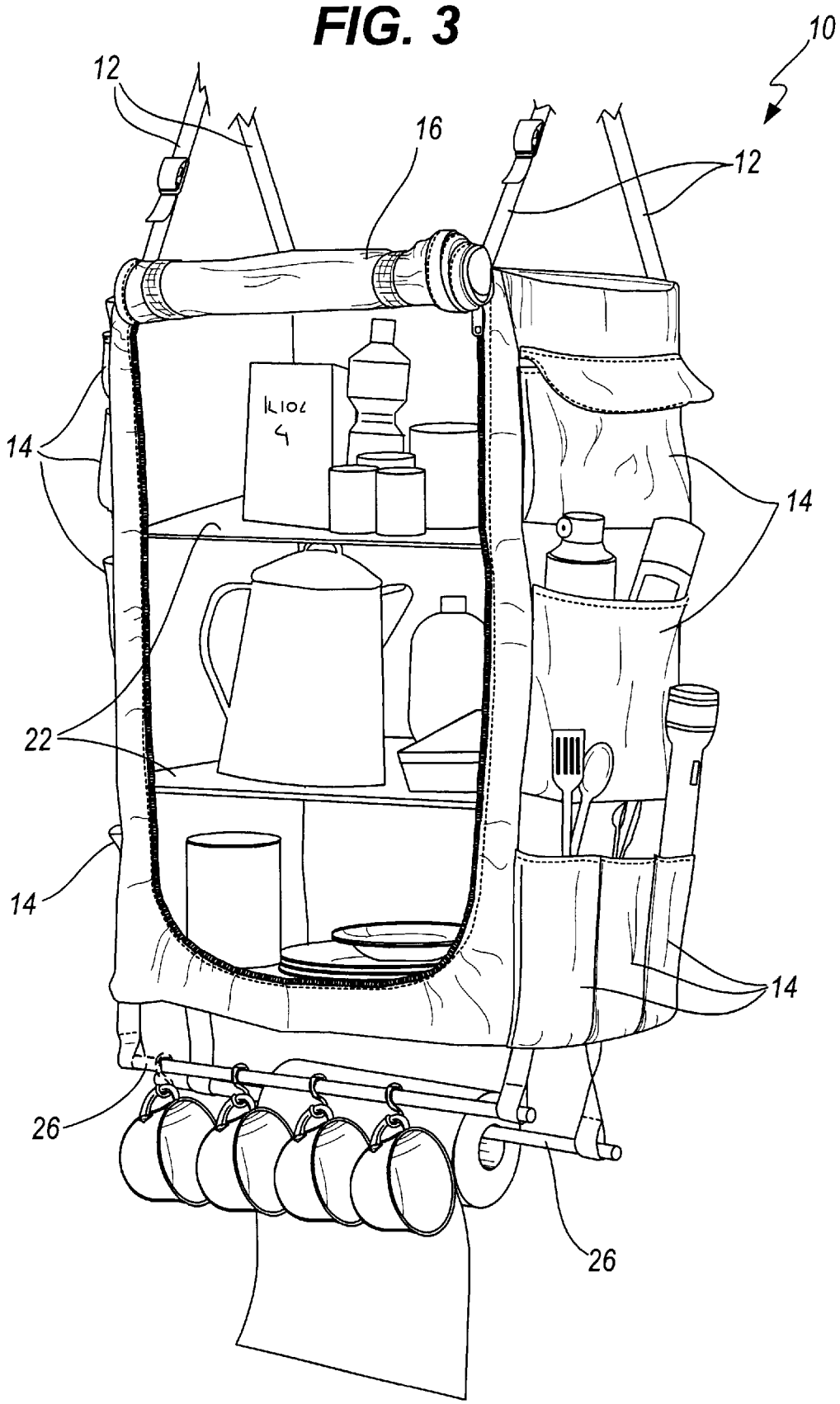
FIG. 3 shows one embodiment of the present invention with the interior exposed and dowel rods provided on the lowermost portion.

Alternatively, with reference to FIGS. 3 and 4, it can be seen that the present device 10 can be fitted with a plurality of shelves 22, with the lower most storage compartment being formed from the bottom most portion of the device 10, with at least one, and preferably at least two, additional shelves 22 reversibly and/or fixedly attached to the interior portion of the organizing device 10 so as to accommodate a variety of containers, food stuffs, etc. As can be further seen, the outside pockets 14 of the device 10 can accommodate various tools, containers, etc. in exterior pockets preferably made from a mesh material to facilitate not only visual inspection of such devices while in the stored position, but also to provide the utmost lightweight device 10 while retaining designed functional characteristics.

As can be further seen from such figure, the exterior covering on the face 16 of the device 10 can be pulled out of the way and stored in a fashion that permits visual inspection of the interior of the device. For example, a cover 16 can be rolled upon itself and placed in a fixed position at the top of the device by straps which hold such rolled fabric in a retained position during inspection and/or use.

Referring to FIG. 4, it can be seen how a paper towel roll 24 can be threaded on such dowel rod 26 to hang descending from the organizing device 10 for easy use by a user once the device 10 is positioned appropriately in a vertical upright hanging position.

To comply with enablement and written description requirements, Applicants incorporate by reference in their entirety the following U.S. Pat.: U.S. Pat. Nos. 5,938,336; 3,786,972; 5,379,906; and 5,036,979.

As may be appreciated of one of skill in the art, various other embodiments of the present invention will be obvious once the present invention is understood. For example, a removable, adjustable shelving can be utilized; internal hinges and/or detachable posts can be provided for support of shelves either along edges or internally to the shelf itself; tripod-type supports can be provided to support the device in a hanging position in the event no suitable static devices are available for hanging the device. Moreover, the present apparatus 10 can be fitted with backpack adjustable assemblies such that the device 10 itself can be carried as a backpack and later used as a hanging organizer once a destination is reached, such backpack straps being also useable as vertical hanging devices.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. An organizer, comprising:

a housing compartment constructed from relatively lightweight, weather resistant material, said housing compartment having an exterior, interior, front side, back side, top side having four comers, bottom side and left and right width sides, said housing compartment being collapsible to and securable in a relatively flat dimension;

at least two shelves positioned within the interior of said housing compartment suitable to accommodate goods placed thereon;

dowel rod attachment means descending from said bottom of said housing compartment to facilitate two ends of a dowel rod;

a plurality of pockets operatively attached to said left and right width sides of said housing compartment;

a cover extending over said front side of said housing compartment, said cover being foldable and securable such that the interior of said housing compartment is exposed; and attachment means for vertically hanging said housing, said attachment means attaching to said top portion of said housing compartment at each of said four comers of said top side of said housing compartment.

2. The organizer of claim 1, wherein said cover comprises transparent material.

* * * * *